US007523645B2

(12) United States Patent
Gammon

(10) Patent No.: US 7,523,645 B2
(45) Date of Patent: Apr. 28, 2009

(54) WATER DETECTOR PROBE

(75) Inventor: Howard M. Gammon, Sea Girt, NJ (US)

(73) Assignee: Gammon Technical Products, Inc., Manasquan, NJ (US)

( * ) Notice: Subject to any disclaimer, the term of this patent is extended or adjusted under 35 U.S.C. 154(b) by 390 days.

(21) Appl. No.: 11/454,687

(22) Filed: Jun. 16, 2006

(65) Prior Publication Data

US 2007/0001864 A1 Jan. 4, 2007

Related U.S. Application Data

(60) Provisional application No. 60/695,630, filed on Jun. 30, 2005.

(51) Int. Cl.
*G01N 11/00* (2006.01)

(52) U.S. Cl. ..... 73/53.01

(58) Field of Classification Search ..... 73/53.01, 73/290 R

See application file for complete search history.

(56) References Cited

U.S. PATENT DOCUMENTS 2,344,512 A * 3/1944 Lanham ..... 73/861.49
2,769,140 A * 10/1956 Obenshain ..... 324/450
3,015,775 A * 1/1962 Coulter et al. ..... 324/71.1
3,169,400 A * 2/1965 Kiramidjian ..... 73/290 R
3,657,926 A * 4/1972 Munson et al. ..... 73/713
3,874,223 A * 4/1975 Miyazaki et al. ..... 73/32 R
4,304,132 A * 12/1981 Snaper ..... 73/304 R
4,879,440 A * 11/1989 Lymburner ..... 200/82 R
4,912,407 A * 3/1990 Gualtieri et al. ..... 324/204
6,058,776 A * 5/2000 Algers et al. ..... 73/304 R
6,820,483 B1 * 11/2004 Beckerman ..... 73/304 C

OTHER PUBLICATIONS

Parker/Thiem, Aircraft Refueling Equipment, Water Sump Controls, Water Detection Systems for Refueling Vehicles, pp. A601.1B and A601.2B, Thiem Industries, Inc., Santa Fe Springs, CA, United States of America.

Crown Products, Inc., Water Detection Probe Systems, 2 pages, Crown Products, Inc., Tulsa, OK, United States of America.

* cited by examiner

*Primary Examiner*—Hezron Williams
*Assistant Examiner*—Rodney T Frank
(74) *Attorney, Agent, or Firm*—Fraser Clemens Martin & Miller LLC; Donald R. Fraser

(57) ABSTRACT

A water detector probe is disclosed which can be wetted with a small quantity of water and including a manually operated screw-type pump to force the water into an electrically conductive central passageway and thence into contact with the fuel side and, as well as, the grounded main body of the probe to complete an electrical circuit which, in turn, controls fuel flow to an aircraft, for example.

8 Claims, 3 Drawing Sheets

WATER DETECTOR PROBE

CROSS-REFERENCE TO RELATED APPLICATION

This application claims the benefit of provisional patent application No. 60/695,630, filed Jun. 30, 2005.

BACKGROUND OF THE INVENTION

1. Field of the Invention

The present invention relates to a water detector probe and more particularly to a probe used for determining the presence of water in the sump of a monitor vessel or of a filter/separator.

2. Description of the Prior Art

The presence of water in a sump of a filter/separator indicates that the jet fuel or other hydrocarbon products contained in the sump have been contaminated with water. Typically, when a maximum allowable level of water is sensed, the pumping of the contaminated material is stopped. Presently, there are two types of automatic systems which are operative to stop fuel flow when water is sensed.

One system incorporates a float that tends to float on the water/fuel interface. The other system is one that employs an electrical conductor which senses a maximum allowable level of water in the sump by electrical conductivity. Since this latter system requires very low electrical power, it is referred to as being intrinsically safe. In other words, should the system create an electrical spark, the system energy is insufficient to ignite an explosive fuel/air mixture.

The present invention involves a probe having special features for periodic testing of the electrical sensing system. There are presently two types of periodic testing systems. One of the systems employs a technique wherein water is injected into the sump of a fuel/separator. Such a system has been found to be undesirable because there could be instances where too much water injected into the system could possibly result in contaminated fuel being pumped into an aircraft. The other electrical system uses a periodic testing technique where water is injected into the internal cavity of the probe such that the water is caused to contact the portion of the electrode on the "air" side, as distinguished from the "fuel" side. If the injected water is also in contact with the body of the probe, continuity is established and a current is caused to flow to activate an intrinsically safe relay in an isolated electrical control box. Then current is caused to flow in an associated circuit to produce a signal to either stop the pumping system or to actuate a valve to prevent any flow of contaminated fuel to an associated aircraft.

One of the problems with the last mentioned system is that a false signal can occur during the test in the event the fuel side of the probe has been contaminated with deposits or has corroded. In either event, the conducting surface of the probe is prevented from being wetted by water in the sump.

It is an object of the present invention to produce a water detector probe which can be wetted with water on the fuel side of the probe to enable the detection of very small quantities of water so as to create no subsequent hazard to an aircraft engine.

SUMMARY OF THE INVENTION

The above object, as well as others, may be achieved by a water detector probe for sensing water contamination in a vessel containing hydrocarbon fluids comprising: a main body having means for attaching the body to the vessel containing hydrocarbon fluids to be tested such that a portion of the body extends into the fluid being tested, the body being electrically conductive; an elongate electrically conductive means disposed within the body having an internal passageway with an inlet at one end communicating with an outlet at the other end, the outlet end extending into the vessel; means for electrically insulating the conductive means from the body; a shroud having an internal cavity, mounted on the outlet end of the conductive means; actuator means for moving the conductive means within the body to and from a position where the cavity of the shroud forms a fluid-tight reservoir with the body and the conductive means and surrounding the outlet end of the conductive means; water metering means communicating with the inlet of the internal passageway of the electrically conductive means; and means for coupling the body and the conductive means to a source of electrical potential to cause an electrical signal to be generated when water is sensed in the reservoir of the shroud.

BRIEF DESCRIPTION OF THE DRAWINGS

The above objects and advantages of the present invention will become readily apparent to those skilled in the art when considered in the light of the attached drawings, in which.

DETAILED DESCRIPTION OF THE PREFERRED EMBODIMENT OF THE INVENTION

Figure 1:
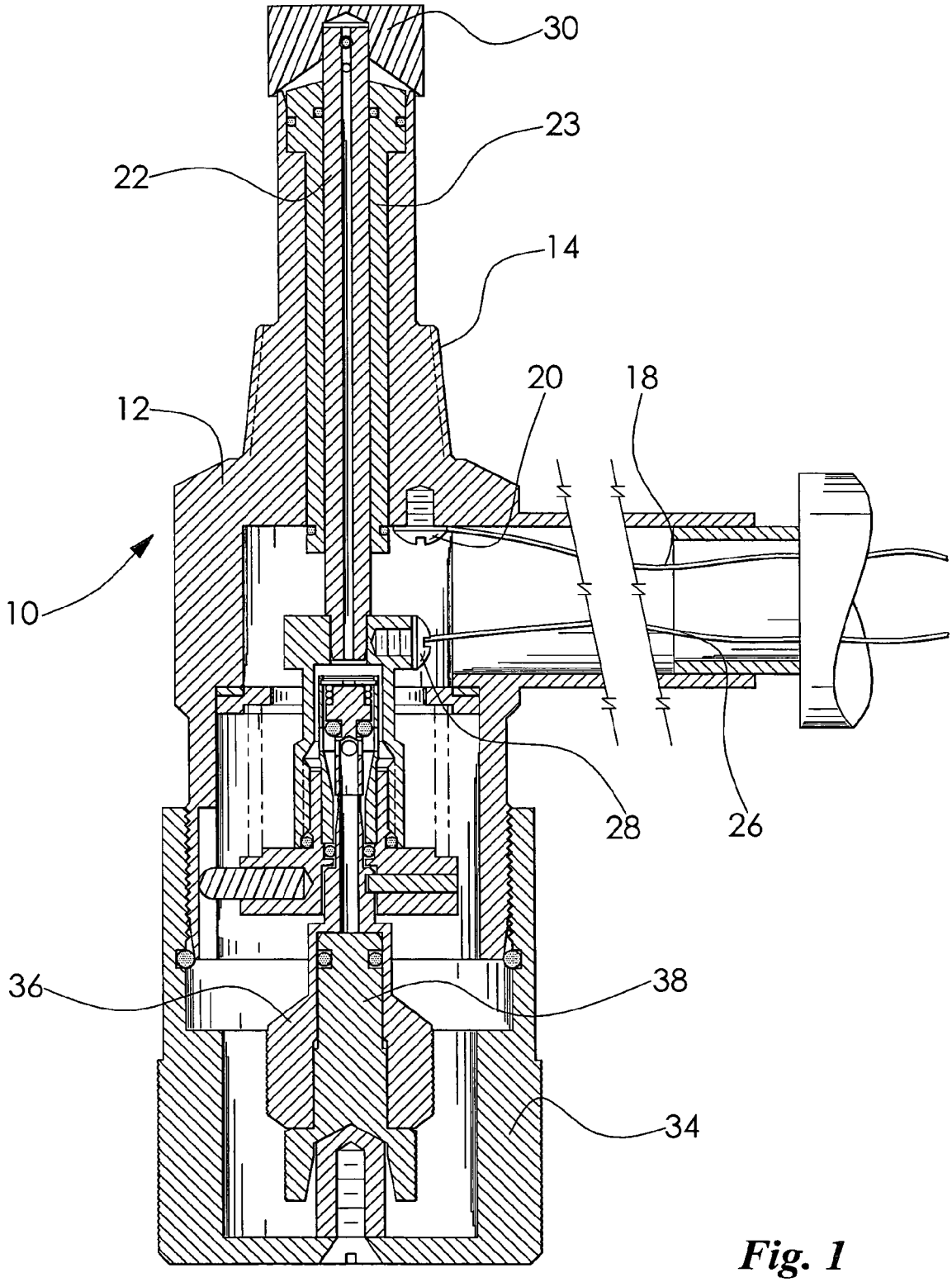
FIG. 1 is a sectional view of a water sensing probe embodying the features of the present invention.
Figure 2:
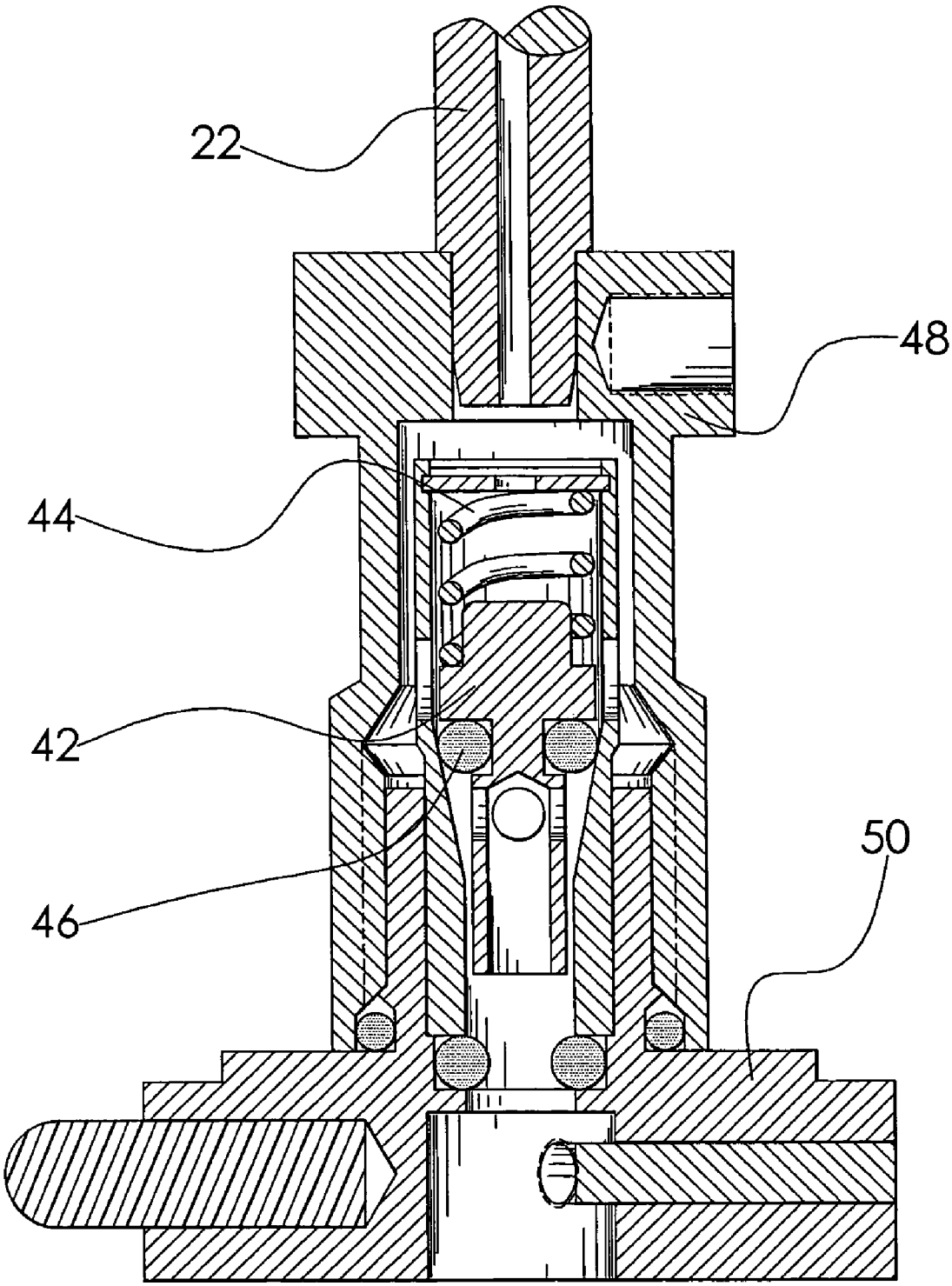
FIG. 2 is an enlarged fragmentary sectional view of a portion of the water pump assembly of the water sensing probe illustrated in FIG. 1.

Referring to FIGS. 1 and 2, there is illustrated a water detector probe, embodying the features of the present invention. More particularly, there is generally illustrated a probe which includes a shroud, having an internal cavity, which is mounted on the outlet end of an internally mounted electrically conductive probe member. When water is injected through the internal passageway of the conductive member, the water will electrically couple the main body and the conductive probe member. If an electrical potential is applied across the main body and the conductive probe member, and, there is no continuity, this means that there is no water bridging from one member to the other. In such condition, the probe is not operative to sense water contamination because the deposits collected on the probe prevent water from contacting the conductive probe member and no resultant signal is generated.

The water detector probe of the present invention includes a shroud, having an internal cavity, mounted on the outlet end of an axially moveable electrically conductive central probe member. When positioned in its operative mode, the cavity of the shroud can receive a small metered amount of water (1 ml.) which will provide a conductive path between the outer body and the moveable conductive probe member. If, when water bridges from one member to the other and no continuity is indicated, the surfaces should be cleaned. If continuity is indicated, the test is successful, and the probe is suitable for use.

Figure 3:
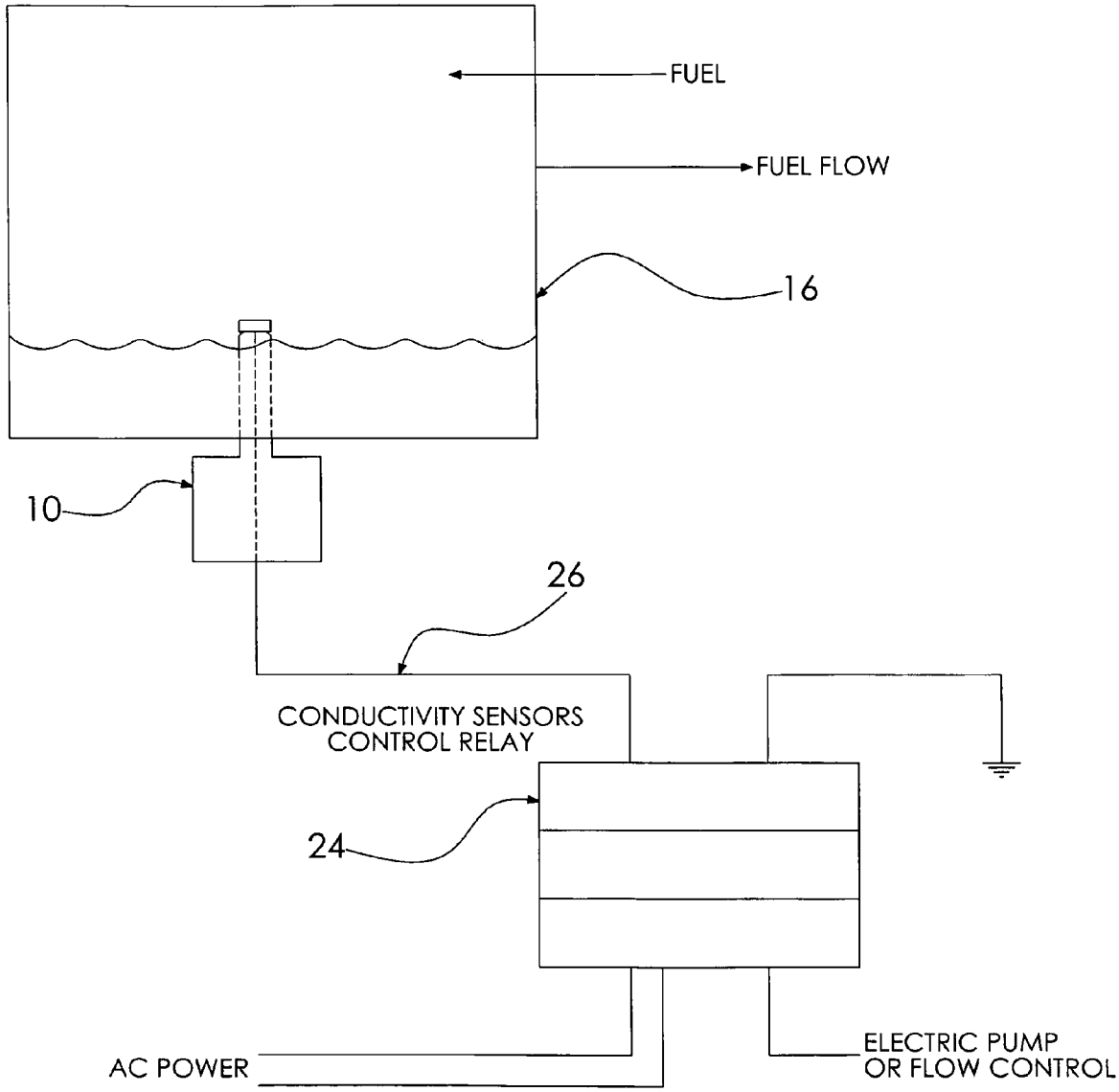
FIG. 3 is a schematic illustration of a system incorporating the probe illustrated in FIG. 1.

In the illustrated embodiment of FIGS. 1 and 2, the water detector probe shown generally indicated by reference numeral 10, includes a main body 12 having an externally threaded section 14 adapted to engage with a cooperating internally threaded section the sump of a filter/separator vessel 16 (schematically illustrated in FIG. 3). The main body 12 is grounded electrically through suitable conductive means 18 connected to a threaded fastener 20. A centrally disposed longitudinally moveable conductive tubular probe 22 is slidably received within a central bore of a non-conductive bushing 23 which effective electrically insulates the probe 22 from the main body 12. The probe 22 is connected to conductivity sensors and associated control relays 24, as illustrated schematically in FIG. 3, through a conductor 26 coupled to the main body 12 by a threaded fastener 28.

Low power intrinsically safe current is applied to the entire internal assemblage from a DC power source. When water is injected through the center passageway of the tubular probe 22, the water is caused to exit an outlet within the cavity of a shroud or tube cap 30 will displace any fuel, if present, and fill the reservoir defined primarily by the cavity of the shroud 30. The shroud or tube cap 30 is electrically non-conductive and preferably made of a plastic material such as polytetrafluoroethylyene, for example. Therefore, when the shroud 30 is tight against the outlet end of the main body 12, electric current can flow from the central probe 22 through the water in the cavity to the grounded main body 12.

Normally, the internal pressure of the fluid within the associated filter/separator vessel 16 tends to force the shroud 30 into contact with end of the main body 12, as illustrated in FIG. 1. Accordingly, it will be appreciated that when a cap assembly 34 is removed from the opposite end of the main body 12, the internal pressure in the associated filter/separator vessel 16 forces the internal assembly to the position of FIG. 1, wherein the cap 30 is in fluid-tight relation against the one end of the main probe body 12.

The water pump of the internal assembly includes an actuator 36 and an associated piston 38 and is disposed within the main body 12. The water pump assembly may be removed from the main body 12 by the rotation of the actuator 36 and the piston 38 causing the assembly to become uncoupled from a bayonet-type connection leaving the inner assembly illustrated in FIG. 2 within the main body 12. Upon release, an internal valve, shown in enlarged view in FIG. 2, closes and prevents any flow of fluid therethrough.

At this juncture, a poppet valve 42 of the internal valve is urged downwardly by a spring 44 causing the valve 42 to seat against an O-ring 46. Upon seating, the valve 42 prevents seepage of fluid from the conical cavity formed by the cap 30 and the end of the main body 12, which may still be under pressure from the associates fuel system under test. Further, it will be understood that the inner assembly, illustrated in FIG. 2, includes a cooperating female coupling 48 having one end threadably coupled to the probe 22 and the other end threadably coupled to an associated male coupling 50. The inner assembly is secured to the outlet end of the actuator 36 and is provided with suitable support means which will limit the to and fro reciprocal movement of the inner assembly and probe 22 within the main body 12 and simultaneously maintain axial alignment thereof.

When the piston 38 is removed from the actuator 36, the actuator 36 can be filled with the metered quantity of water. During the filling procedure, the pump assembly is held such that the outlet or small end is maintained in a downward position with the finger of the operator closing the outlet opening.

After the insertion of the metered quantity of water, the piston 38 is inserted into the actuator 36 and by appropriate relative rotation, the piston 38 and the actuator 36 become threadably engaged. By holding the assembly, with the outlet end disposed upwardly, the piston 38 is rotated to displace any air that may have been trapped. The piston 38 and the actuator 36 are then reinserted to a fixed position with the bayonet coupling which simultaneously opens the poppet valve. By effecting rotation of the piston 28, water is forced into the passageway in the probe 22 and is ejected into the chamber formed on the inner surface of the shroud 30. The assembly is now ready for testing the continuity of the detector probe.

When the test has been completed, the water pump assembly can be removed. The water remaining in the assembly should be removed to prevent the water from freezing in cold weather. Typically, the piston 38 is threaded all the way into the actuator 36, and then the assembly can be reattached to the main body which effects an opening of the poppet valve 32. Then an outer cap 34 is threadably installed on the outer body 12. As the cap 34 is installed, the cap 34 causes the internal assembly in FIG. 1 to lift up, exposing a conical cavity under shroud 24 to permit fluid in the sump of the filter separator vessel 16 to make contact with the probe 22. The system is then in an operating mode for fueling service, for example, to be exposed to the fluid in the sump to ultimately sense the collection of water.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A water detector for sensing water contamination in a vessel containing hydrocarbon fluid, comprising:

a main body;

means for attaching the body to a vessel;

an electrically conductive probe having an internal passageway with an inlet and a spaced apart outlet communicating with the vessel;

means for electrically insulating the probe from the body;

a shroud having an internal cavity mounted on the outlet of the probe;

actuator means for moving the probe within the body to and from a position wherein the cavity of the shroud forms a fluid tight reservoir with the body and the probe wherein the reservoir surrounds the outlet end of the probe;

water metering means communicating with the inlet of the probe;

a valve disposed adjacent the inlet of the probe and the water metering means; and means for coupling the body and the probe to a source of electrical potential to cause an electrical signal to be generated when water is sensed in the reservoir of the shroud.

2. A water detector according to claim 1 wherein the shroud is formed of plastic.

3. A water detector according to claim 2 wherein the plastic is polytetrafluroethylene.

4. A water detector according to claim 1 wherein the means for electrically insulating the probe from the main body includes a bushing.

5. A water detector according to claim 4 wherein the probe is slidingly received within the bushing.

6. A water detector according to claim 1 wherein the valve is normally closed.

7. A water detector according to claim 1 including a spring normally urging the valve to a closed position.

8. A water detector according to claim 1 including means for supporting and guiding the to and fro motion of the actuator within the main body.

* * * * *